US005295675A

United States Patent [19]

Hain

[11] Patent Number: 5,295,675

[45] Date of Patent: Mar. 22, 1994

[54] SHEET HANDLING APPARATUS HAVING CONTROLLED PRESSURE ROLLS TO ENSURE FEEDING OF A SINGLE SHEET

[75] Inventor: David A. Hain, Dundee, Scotland

[73] Assignee: NCR Corporation, Dayton, Ohio

[21] Appl. No.: 85,623

[22] Filed: Jul. 2, 1993

[30] Foreign Application Priority Data

Mar. 23, 1993 [GB] United Kingdom ..... 9306009

[51] Int. Cl.[5] ..... B65H 5/08; B65H 1/08

[52] U.S. Cl. ..... 271/12; 271/94; 271/99; 271/104; 271/35; 271/121; 271/122; 271/126; 271/160; 271/258

[58] Field of Search ..... 271/11, 12, 35, 94, 271/99, 104, 105, 117, 122, 124, 160, 258, 273, 274, 276, 121, 126, 147

[56] References Cited

U.S. PATENT DOCUMENTS

| | | | |
|---|---|---|---|
| 3,542,357 | 11/1970 | Stoothoff | 271/11 X |
| 4,269,405 | 5/1981 | Mitzel . | |
| 4,345,752 | 8/1982 | Nakamura et al. . | |
| 4,463,942 | 8/1984 | Newsome | 271/105 X |
| 4,575,068 | 3/1986 | Kato | 271/122 |
| 4,739,982 | 4/1988 | Hain . | |
| 4,822,018 | 4/1989 | Hain . | |
| 4,871,162 | 10/1989 | Imai et al. | 271/122 X |
| 5,201,508 | 4/1993 | Kuo | 271/121 X |
| 5,219,156 | 6/1993 | Mori | 271/160 X |

FOREIGN PATENT DOCUMENTS

| | | | |
|---|---|---|---|
| 606630 | 10/1960 | Canada | 271/94 |
| 3311976 | 10/1984 | Fed. Rep. of Germany . | |
| 1-97246 | 8/1989 | Japan | 271/35 |
| 102018 | 4/1991 | Japan | 271/126 |
| 158345 | 7/1991 | Japan | 271/121 |
| 2198122 | 6/1988 | United Kingdom . | |

*Primary Examiner*—Robert P. Olszewski
*Assistant Examiner*—Boris Milef
*Attorney, Agent, or Firm*—Albert L. Sessler, Jr.

[57] ABSTRACT

A currency note picking and feeding apparatus (10) includes feed belts (28) for feeding notes from the bottom of a stack of notes (20) to the nip of a rotating suction drum (22) and separating belts (64) of frictional material which engage with the periphery of the drum (22). The suction drum (22) grips and feeds the lowermost note to a further conveyor means (76,82,84), with the separating belts (64) holding back any notes superposed on the lowermost note. If a feeding failure of the drum (22) occurs, as recognized by photodetector (90) associated with the further conveyor (76,82,84) failing to sense the passage of a note within a predetermined time interval, then pivotably mounted pressure rolls (92) are caused to be moved temporarily into cooperative association with the suction drum (22) so as to press the notes present at the nip of the drum (22) and the separating belts (64) against the drum (22), thereby increasing the grip of the drum (22) on the lowermost note.

9 Claims, 4 Drawing Sheets

SHEET HANDLING APPARATUS HAVING CONTROLLED PRESSURE ROLLS TO ENSURE FEEDING OF A SINGLE SHEET

BACKGROUND OF THE INVENTION

This invention relates to a sheet handling apparatus.

An apparatus in accordance with the invention could be used, for example, as part of an apparatus for loading currency notes into a currency cassette.

Currency cassettes are used in automated teller machines (ATMs) of the kind wherein a user inserts a customer identifying card into the machine and then enters certain data (such as a personal identification number, quantity of currency required or to be paid in, type of transaction, etc.) upon one or more keyboards associated with the machine. The machine will then process the transaction, update the user's account to reflect the current transaction, dispense cash, when requested, extracted from one or more currency cassettes mounted in the machine, and return the card to the user as part of a routine operation. It is common for an ATM to dispense currency notes of at least two different denominations, in which case the ATM will normally include a separate currency cassette for notes of each particular denomination.

The manual loading of currency notes into a cassette can be tedious and time-consuming. Accordingly, the need exists for a means for facilitating or automating the loading of currency cassettes. From British Patent Application No. GB-A-2198122 there is known an apparatus for automatically loading notes into a currency cassette. One embodiment of such apparatus includes a carriage which is reciprocally movable between a stacking position remote from the cassette and a loading position adjacent an open end of the cassette. In operation, a stack of notes is formed on the carriage at the stacking position and carried by the carriage to the loading position. During a return movement of the carriage to the stacking position this stack is laid down into the open end of the cassette.

It is important for the correct operation of the cash dispensing mechanism of an ATM that the currency notes contained in the or each currency cassette mounted in the ATM are of a suitable condition for handling by the cash dispensing mechanism. For example, if currency notes contained in a currency cassette are torn or have foreign matter such as adhesive tape or staples attached to them, then there is a risk that such notes may become jammed in the associated cash dispensing mechanism. Thus, care must be taken when loading currency cassettes that unsuitable notes should be excluded. If notes are to be loaded into a currency cassette from a stack of unscreened notes, it is important that, prior to loading, the notes pass through a separating mechanism from which the notes are fed singly through an appropriate screening system. The aforementioned document GB-A-2198122 does not disclose any mechanism for separating notes from a stack so as to bring about feeding of the notes in single manner.

From U.S. Pat. No. 4,269,405, there is known a sheet separating mechanism including a rotating feed drum having suction openings associated with friction rings which together serve to pull the lowermost sheet of a stack of sheets to a position where the lowermost sheet is engaged by sheet transport means. The mechanism also includes a keeping back roller associated with, and rotating in an opposed manner with respect to, the feed drum for ensuring that only one sheet at a time is fed to the transport means. A problem experienced with sheet separating mechanisms of this kind in which keeping back or feed restraining means are associated with sheet feeding means is that from time to time the feed restraining means may overcome the feeding action of the feeding means and thereby cause an interruption in the feeding of sheets to subsequent sheet transport means.

SUMMARY OF THE INVENTION

According to the invention there is provided a sheet handling apparatus, comprising: first feeding means for removing sheets from a stack; second feeding means for receiving sheets fed thereto by said first feeding means; third feeding means for receiving sheets fed thereto by said second feeding means; sheet feed restraining means associated with said second feeding means and arranged to inhibit the feeding of two or more superposed sheets to said third feeding means; pressure means movable between a home, non-operative position in which said pressure means are out of cooperative association with said second feeding means, and an operative position in which said pressure means are in cooperative association with said second feeding means; and sensing and control means for sensing in operation a cessation in the feeding of sheets from said second feeding means to said third feeding means and for causing said pressure means to be moved to said operative position in the event of such cessation so as to press a sheet engaged by said second feeding means against said second feeding means and thereby facilitate the feeding of this sheet to said third feeding means.

It is an object of the present invention to provide a sheet handling apparatus for removing sheets from a stack and for bringing about feeding of the sheets in single manner, in which the problem mentioned above in the Background of the Invention is alleviated.

BRIEF DESCRIPTION OF THE DRAWINGS

One embodiment of the invention will now be described by way of example with reference to the accompanying drawings, in which.

DETAILED DESCRIPTION

Figure 1:
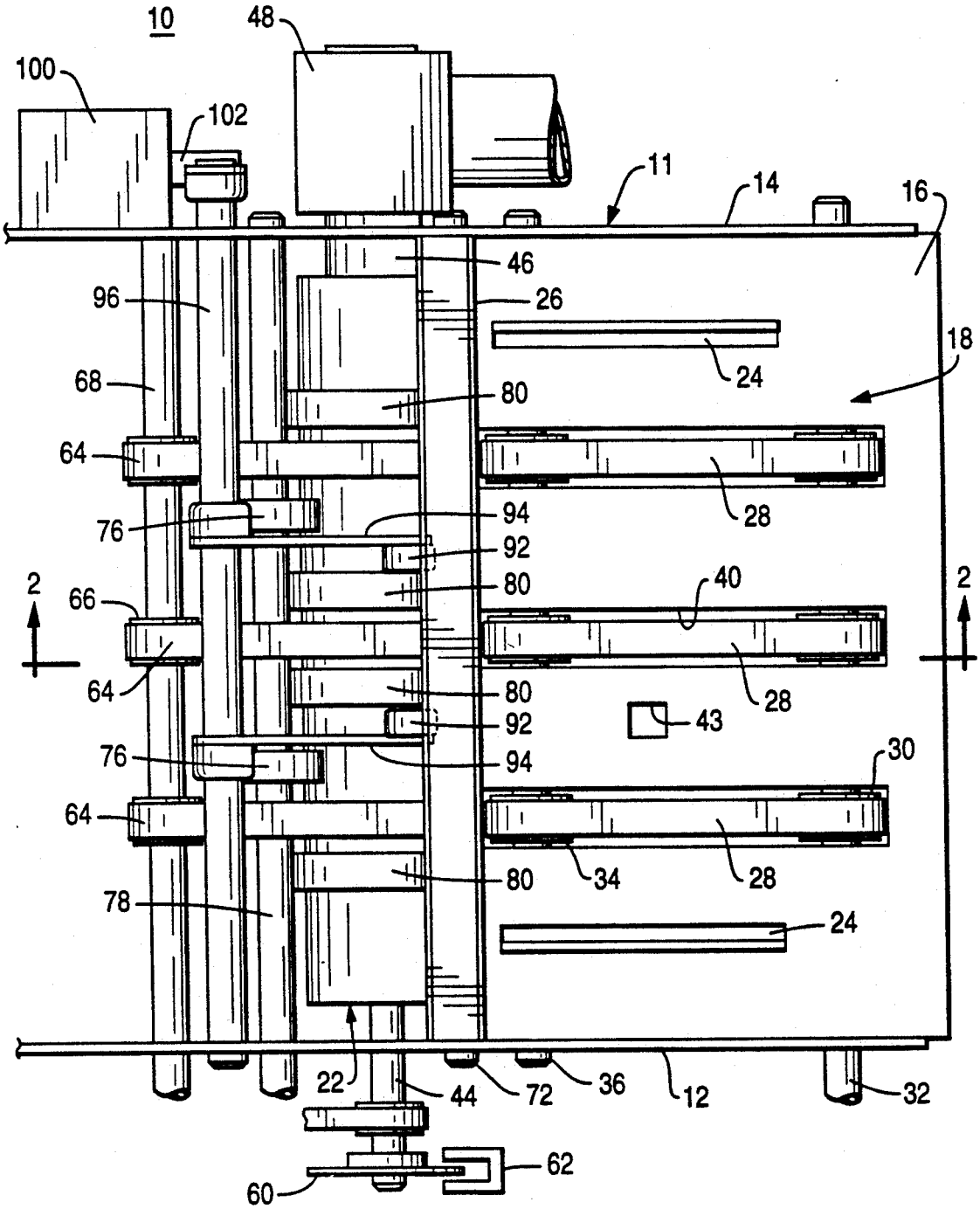
FIG. 1 is a plan view of a currency note handling apparatus in accordance with the invention.
Figure 2:
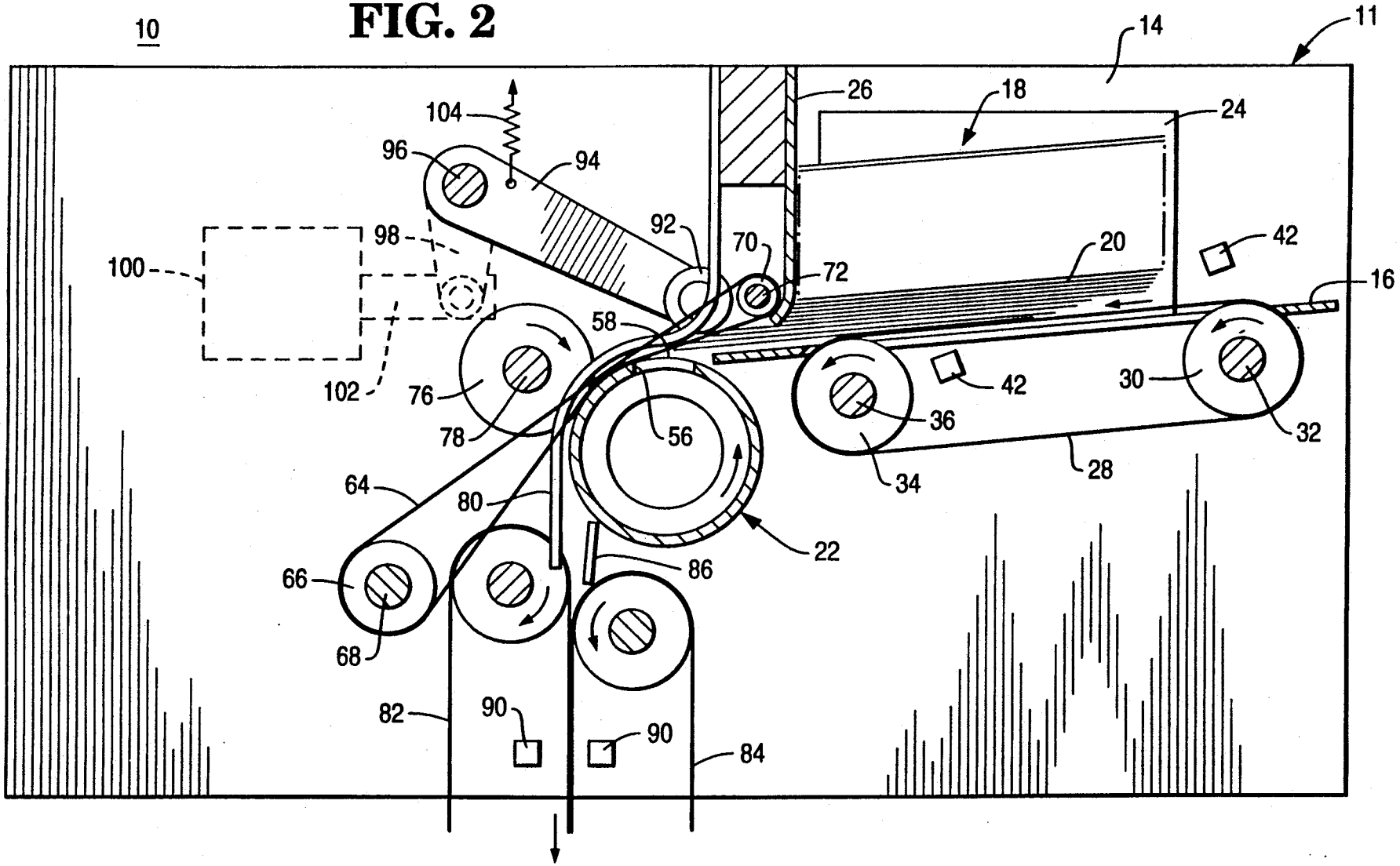
FIG. 2 is a sectional side elevational view of the apparatus of FIG. 1 with a stack of notes present in a note receptacle of the apparatus, the section being taken along the line 2—2 of FIG. 1.

Referring first to FIGS. 1 and 2, the currency note handling apparatus 10 shown therein includes a supporting framework 11 having parallel side walls 12 and 14. Extending between the side walls 12 and 14 is a platform 16 which forms the base of a receptacle 18 for holding a stack of notes 20 (FIG. 2), the platform 16 sloping slightly downwards towards a suction drum 22 as shown in FIG. 2. Two parallel and vertical guide plates 24 are mounted on the platform 16. The plates 24 form side walls of the receptacle 18, the spacing apart of the guide plates 24 being adjustable so that, in operation of the apparatus 10, the stack of notes 20 fits loosely between the plates 24 with the long dimension of each note being perpendicular to the plates 24. Apart from the bottom few notes in the stack 20, the front edges of the notes, that is to say the left hand edges with reference to FIG. 2, abut against a vertical plate 26 which forms the front wall of the receptacle 18. As seen in FIG. 2, the bottom edge of the plate 26 is curved towards the drum 22 and is positioned a short distance above the platform 16 so as to permit the bottom few notes in the stack 20 to be fed under the plate 26 towards the drum 22.

Figure 5:
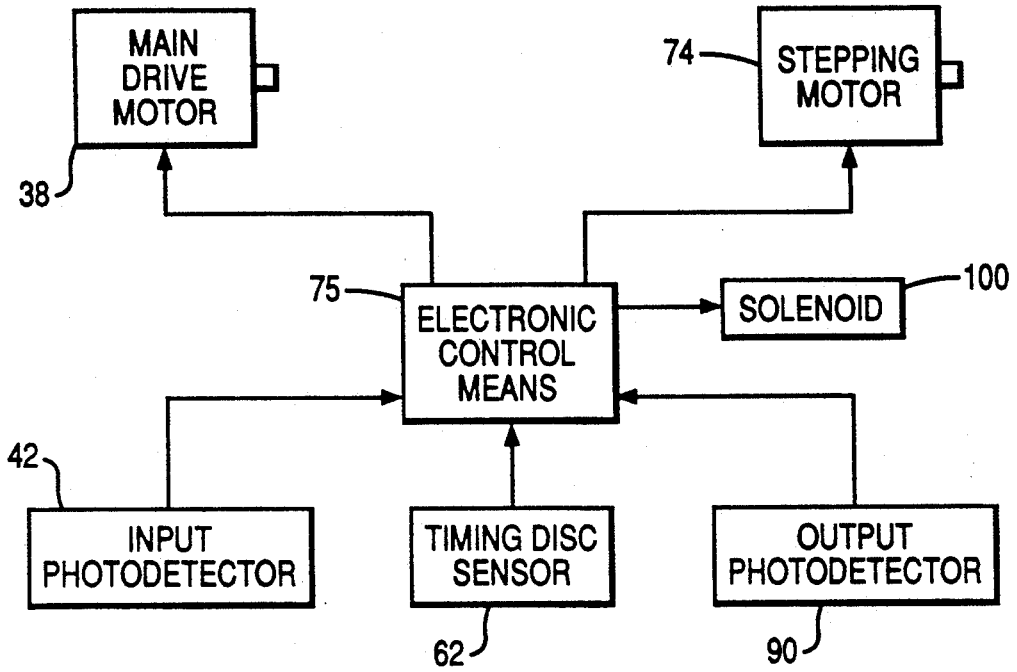
FIG. 5 is a block circuit diagram showing electrical interconnections of the note handling apparatus.

Three endless feed belts 28 are associated with the platform 16. Each belt 28 passes around a respective rear drive pulley 30 secured on a drive shaft 32, and around a respective front idler pulley 34 rotatably mounted on a shaft 36. The shafts 32 and 36 extend between the side walls 12 and 14 beneath the platform 16, the shaft 32 being driven in operation by a main drive motor 38 (FIG. 5). The pulleys 30 and 34 associated with each belt 28 project through an associated slot 40 formed in the platform 16, with the upper portions of the belts 28 extending parallel to, and being positioned a short distance (1.5 to 2 millimeters) above, the upper surface of the platform 16. Thus, in operation, the lowermost note of the stack of notes 20 in the receptacle 18 is engaged by the belts 28 whereby this note 20 is fed by the belts 28 towards the suction drum 22. Photodetector means 42 (FIGS. 2 and 5) are associated with the receptacle 18 for sensing when one or more notes are present in the receptacle 18 and covering an aperture 43 in the platform 16.

Figure 3:
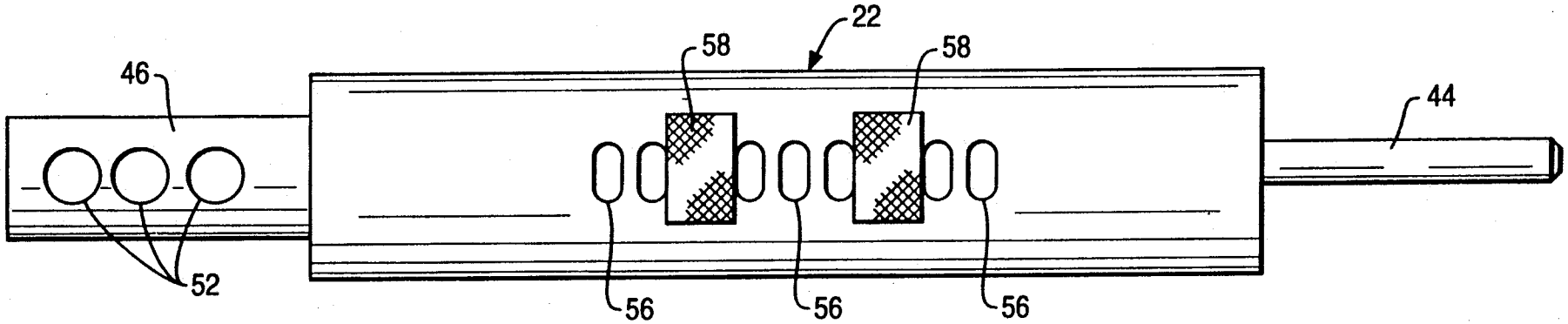
FIG. 3 is an enlarged plan view of a suction drum included in the apparatus of FIGS. 1 and 2.
Figure 4:
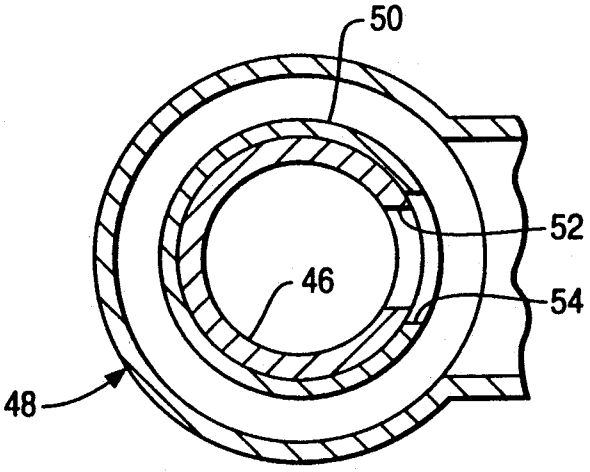
FIG. 4 is a sectional view illustrating connection means for connecting the drum of FIG. 3 to a vacuum pump.

Referring additionally to FIGS. 3 and 4, the suction drum 22 is rotatably mounted between the side walls 12 and 14. A shaft 44 projecting from one end of the drum 22 extends beyond, and is rotatably mounted with respect to, the side wall 12, while a tubular extension 46 of the drum 22, which is of smaller diameter than the drum 22, extends beyond, and is rotatably mounted with respect to, the side wall 14. The tubular extension 46 communicates with the interior of the drum 22 and is connected by means of a fixed connector member 48 to a vacuum pump (not shown). As shown in FIG. 4, the tubular extension 46 is rotatably mounted in an inner sleeve 50 of the connector member 48. For a part of each revolution of the drum 22, the drum 22 communicates with the vacuum pump via apertures 52 which are formed in the tubular extension 46 and which during each revolution come into register with corresponding apertures 54 formed in the sleeve 50. As shown in FIG. 3, a row of apertures 56 are formed in the drum 22. Interposed with respect to the apertures 56 on the external surface of the drum 22 are two surface areas 58 of frictional material such as silicone rubber. It will be appreciated that for part of each revolution of the drum 22, when the drum 22 is in communication with the vacuum pump, the drum 22 exerts a suction effect on a note fed to the drum 22 by the feed belts 28, and that the presence of the frictional areas 58 enhances the grip exerted by the drum 22 on this note. A timing disc 60 (FIG. 1) is provided on that end of the shaft 44 remote from the drum 22, the disc 60 being associated with a disc sensor 62. The shaft 44 is driven by the main drive motor 38 whereby the drum 22 is driven continuously in operation in a counterclockwise direction (with reference to FIG. 2).

Three feed restraining or separating belts 64 are associated with the drum 22. The belts 64 are formed of a suitable material such as neoprene rubber to provide good wear and frictional characteristics. Each belt 64 passes around a respective drive-pulley 66 secured on a drive shaft 68 and around a respective idler pulley 70 rotatably mounted on a shaft 72. As shown in FIG. 2, the belts 64 engage with, and pass a short arcuate distance around the periphery of, the drum 22. The shafts 68 and 72 extend between the side walls 12 and 14, the shaft 68 being arranged to be driven in operation by a stepping motor 74 (FIG. 5). Although normally the belts 64 are stationary, they are intermittently fed by the motor 74 a short distance around the pulleys 66 and 70 for a purpose which will be explained later. Operation of the stepping motor 74 and the main drive motor 38 is controlled by electronic control means 75 (FIG. 5).

It should be understood that the suction drum 22 serves as a feeding means for onwardly feeding one by one notes fed to it by the feed belts 28, with the separating belts 64 serving to hold back any note or notes superposed on the note engaged by the drum 22.

Figure 6:
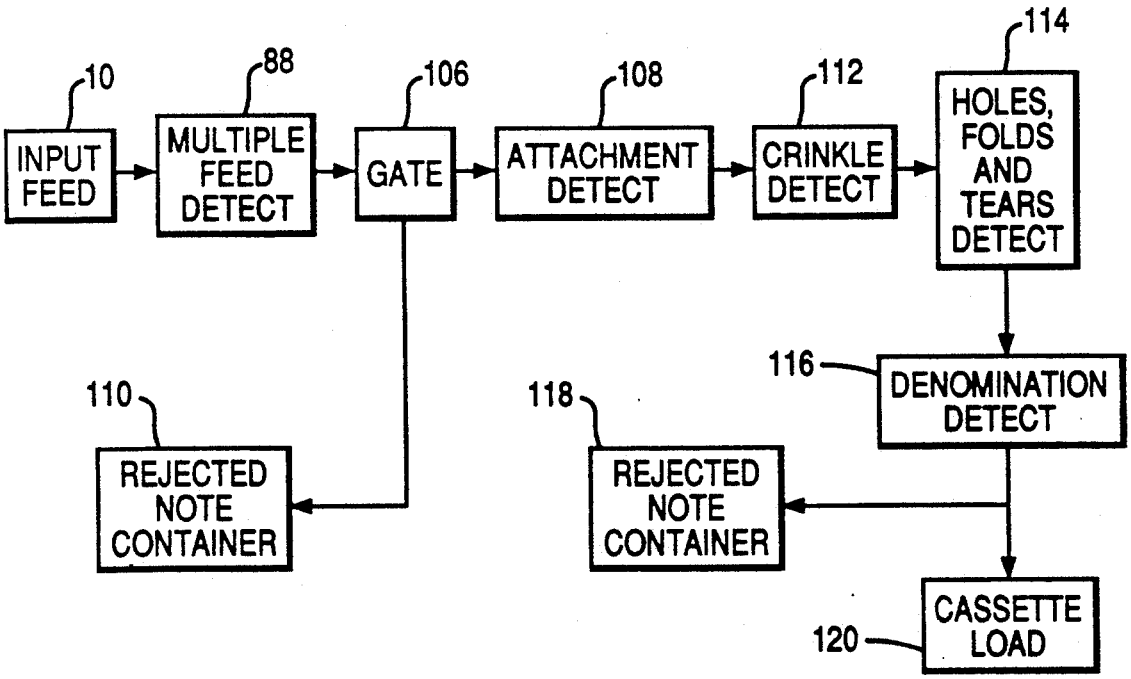
FIG. 6 is a schematic block diagram of a currency note screening and loading system incorporating the note handling apparatus.

Two rubber feed rolls 76 which are secured on a drive shaft 78 extending between the side walls 12 and 14 are in cooperative engagement with the periphery of the suction drum 22. The feed rolls 76 are interposed with respect to the separating belts 64 and a number of guide members 80, as shown in FIG. 1. The drive shaft 78 is driven by the main drive motor 38. The feed rolls 76 are arranged to engage a note onwardly fed by the suction drum 22, the rolls 76 engaging this note downstream of the location where the separating belts 64 first come into engagement with the drum 22 in the direction of feed of the note. Thus, in normal operation, the rolls 76 will engage a single note fed by the drum 22, and, together with the drum 22, the rolls 76 feed this note to the nip of further endless belt feed means 82 and 84 which are also driven in operation by the main drive motor 38. Between the rolls 76 and the feed means 82 and 84, each note is fed between the guide members 80 and further guide means 86 (FIG. 2). The feed means 82 and 84 serve in normal operation to feed notes one by one along a feed path to multiple feed detect means 88 (FIG. 6). The passage of a note along this last-mentioned feed path is sensed by photodetector means 90 (FIGS. 2 and 5) which send a signal to the electronic control means 75 indicating that the photodetector means 90 have sensed the passage of the note. As will be described later, after passing through the multiple feed detect means 88, each note is fed to subsequent modules of the note screening and loading system shown in FIG. 6.

Associated with the suction drum 22 are two pressure rolls 92 of polyurethane which are located adjacent the outer sides of the innermost pair of guide members 80 as shown in FIG. 1. The pressure rolls 92 are respectively rotatably mounted on corresponding ends of two arms 94, the other ends of which are secured on a shaft 96 which extends between, and is rotatably mounted with respect to, the side plates 12 and 14. One end of the shaft 96 projects beyond the side wall 14 and this end is secured to one end of a link member 98. A solenoid 100 having an armature 102 is mounted on the outside of the side wall 14, the free end of the armature 102 being pivotably connected to that end of the link member 98 remote from the shaft 96. The pressure rolls 92 and the arms 94 are normally held by spring means 104 in an inoperative, home position as shown in FIG. 2, in which the pressure rolls 92 are out of engagement with the suction drum 22. Energization of the solenoid 100, which is brought about under the control of the electronic control means 75, causes the arms 94 to pivot in a clockwise direction with reference to FIG. 2 so as to bring the pressure rolls 92 into an operative position in which they are in cooperative association with the periphery of the drum 22.

The operation of the currency note handling apparatus 10 will now be described with additional reference to FIG. 5. Initially the receptacle 18 is empty of notes, and the motors 38 and 74 and the solenoid 100 are all in a de-energized condition. When a stack of notes 20 is loaded into the receptacle 18, the photodetector means 42 sense the covering of the aperture 43 in the platform 16 by the notes and send a signal to the electronic control means 75. Upon receipt of this signal, the electronic control means 75 energizes the main drive motor 38 so as to bring about operation of the feed belts 28 and the feed means 82 and 84, and also rotation of the suction drum 22 and the associated rollers 76. While the drum 22 is rotating, the timing disc sensor 62 sends a continuous series of timing pulses to the electronic control means 75, a predetermined number of pulses being generated for each complete revolution of the drum 22. In addition, at this time the electronic control means 75 causes the vacuum pump to commence operation.

The feed belts 28 feed the lowermost note in the stack 20, together with a few of the notes immediately above the lowermost note, under the bottom edge of the plate 26 towards the nip of the suction drum 22 and the separating belts 64 which at this time are stationary. When the leading edges of the notes being fed reach this nip, the notes are stopped until that part of the periphery of the drum 22 which includes the apertures 56 and the associated frictional areas 58 comes into engagement with the lowermost note. Shortly before said part of the drum 22 engages with the lowermost note, the drum 22 comes into communication with the vacuum pump and remains in communication with the pump for the whole of the time that said part is in engagement with the lowermost note. Thus, due to a suction and frictional effect the drum 22 exerts a firm grip on the lowermost note and feeds this note in the direction of rotation of the drum 22 until the note reaches the nip of the feed rollers 76 and the drum 22. It should be understood that the grip exerted by the drum 22 on the lowermost note is greater than the frictional effect exerted by the separating belts 64 on this note. However, the frictional effect of the belts 64 is normally effective to prevent any note other than the lowermost note being fed together with the lowermost note towards the nip of the rollers 76 and the drum 22.

After the lowermost note reaches this last mentioned nip, it is fed by the rollers 76 and the drum 22 to the nip of the feed means 82 and 84. This note is then fed by the feed means 82 and 84 along a feed path defined by the feed means 82 and 84 to the multiple feed detect means 88 (FIG. 6). During this feeding operation, the photodetector means 90 send a signal to the electronic control means 75 indicating that the photodetector means 90 have sensed the passage of the note along this feed path. Following the feeding by the drum 22 and the rollers 76 of the lowermost note in the stack 20 to the feed means 82 and 84, the next note in the stack 20 (which has now become the lowermost note) is engaged by that part of the drum 22 including the apertures 56 and frictional areas 58 during the next revolution of the drum 22. This note is then fed to the multiple feed detect means 88 in the same manner as described for the previously fed note. In normal operation, for so long as one or more notes remain in the receptacle 18 covering the aperture 43 the apparatus 10 continues to feed successive notes from the stack 20 one by one to the multiple feed detect means 88 in the manner described, the photodetector means 90 sending a signal to the electronic control means 75 for each note thus fed. If for some reason a note engaged by the drum 22 fails to be fed to the feed means 82 and 84, due for example to the grip exerted by the drum 22 on this note failing to overcoming the holding back effect of the separating belts 64, then this failure is recognized by the electronic control means 75 by virtue of the electronic control means 75 failing to receive a signal from the photodetector means 90 during a predetermined time interval as defined by the receipt by the electronic control means 75 of a predetermined number of timing pulses from the timing disc sensor 62.

When such a feeding failure is recognized by the electronic control means 75, then the electronic control means 75 energizes the solenoid 100 so as to move the pressure rolls 92 to their operative position in which they are in cooperative association with the suction drum 22 at a location upstream of the area of engagement between the separating belts 64 and the drum 22. When the pressure rolls 92 are moved to their operative position, they press the small batch of notes that are present at the nip of the drum 22 and the separating belts 64 against the periphery of the drum 22. The pressure exerted by the rolls 92 on this batch of notes enhances the grip exerted by the drum 22 on the note in contact with the drum 22 by an extent sufficient to overcome the holding back effect of the belts 64. As a result, the drum 22 is now effective to feed this note to the feed rollers 76 and hence to the feeding means 82 and 84. The drum 22 may also feed to the feed rollers 76 together with the last-mentioned note one or more of the other notes present in the batch pressed by the pressure rolls 92 against the drum 22. Thus, a plurality of superposed notes may be fed onwardly by the feed rollers 76 and the drum 22 and by the feed means 82 and 84, but this multiple feeding will be detected by the multiple feed detect means 88. Irrespective of whether the drum 22 feeds onwardly a single note or a plurality of superposed notes as a result of the movement of the pressure rolls 92 to their operative position, the rolls 92 are effective in clearing the feed jam that had occurred at the nip of the separating rollers 64 and the drum 22. Upon this jam being cleared as indicated by the photodetector 90 sending a signal to the electronic control means 75, the electronic control means 75 deenergizes the solenoid 100, thereby causing the pressure rolls 92 to be returned to their home position under the action of the spring means 104. Normal operation of the apparatus 10 then resumes with notes being fed by the feed means 82 and 84 one by one to the multiple feed detect means 88. Thus, it will be appreciated that the pressure rolls 92 enable normal operation of the apparatus 10 to be resumed with a minimum of delay following the occurrence of a feed jam.

Normally the separating belts 64 are stationary. In order to even out wear on the belts 64, the electronic control means 75 periodically energizes the stepping motor 74 for short periods so as to bring about small movements of the belts 64 around the pulleys 66 and 70 and thereby bring different parts of the belts 64 into cooperative engagement with the periphery of the drum 22. It is arranged that these movements of the belts 64 take place while no notes are present in the receptacle 18 and while the main drive motor 38 is inoperative.

The apparatus 10 has the advantages that it is of simple construction and is reliable in operation, and that it incorporates simple means for causing the apparatus 10 to resume normal operation following an interruption in the feeding action of the suction drum 22.

As previously mentioned, the apparatus 10 could form part of a currency note screening and loading system such as is shown in FIG. 6. Referring to FIG. 6, the apparatus 10 serves in normal operation to feed currency notes one by one to the multiple feed detect means 88 from a stack of notes 20 held in the receptacle 18 of the apparatus 10. From the multiple feed detect means 88 the notes are fed via a gate 106 to an attachment detector 108 which detects the presence of staples or other attachments to the notes. If the detect means 88 detects the passage of a plurality of superposed notes then these notes are diverted by the gate 106 to a rejected note container 110. After passing through the attachment detector 108, the notes are fed in turn through a detector 112 which detects crinkles, through a detector 114 which detects holes, folds and tears, and through a detector 116 which detects the denominational value of the notes. If any of the currency notes is found to be unacceptable by any of the detectors 108, 112 and 114, or is found to be of the wrong denomination by the detector 116 then it is transported along a branch line to a further rejected note container 118. Otherwise the note is fed to a loading apparatus 120 where it is loaded into a currency cassette.

What is claimed is:

1. Sheet handling apparatus, comprising:

first feeding means for removing sheets from a stack;

second feeding means for receiving sheets fed thereto by said first feeding means;

third feeding means for receiving sheets fed thereto by said second feeding means;

sheet feed restraining means associated with said second feeding means and arranged to inhibit the feeding of two or more superposed sheets to said third feeding means;

pressure means movable between a home, nonoperative position in which said pressure means are out of cooperative association with said second feeding means, and an operative position in which said pressure means are in cooperative association with said second feeding means; and sensing and control means for sensing in operation a cessation in the feeding of sheets from said second feeding means to said third feeding means and for causing said pressure means to be moved to said operative position in the event of such cessation so as to press a sheet engaged by said second feeding means against said second feeding means and thereby facilitate the feeding of this sheet to said third feeding means.

2. An apparatus in accordance with claim 1, in which said second feeding means comprises a rotatable suction drum.

3. An apparatus in accordance with claim 2, in which the periphery of said drum is provided with apertures and associated frictional surfaces which together serve to exert a grip on a sheet fed to said drum, for onward feeding of this sheet to said third feeding means.

4. An apparatus in accordance with claim 2, in which said sheet feed restraining means comprise frictional belt means which are in cooperative engagement with, and extend partly around, the periphery of said drum, said belt means being arranged to be stationary during feeding operation of said drum.

5. An apparatus in accordance with claim 4, in which said frictional belt means comprise endless belt means, and also including control means for bringing about periodic movement of said endless belt means so as to bring different parts of said endless belt means into cooperative engagement with the periphery of said drum.

6. An apparatus in accordance with claim 4, in which said pressure means are arranged to be brought into cooperative association with said drum at a location upstream of the area of engagement between said frictional belt means and said drum.

7. An apparatus in accordance with claim 2, in which said pressure means comprise roll means which are arranged to be in cooperative association with the periphery of said drum when in their operative position.

8. An apparatus in accordance with claim 2, in which said sensing and control means include detector means for sensing the passage of a sheet along a feed path defined by said third feeding means, said sensing and control means being arranged to cause said pressure means to be moved to said operative position in the event of said detector means failing to sense said passage during a predetermined time interval in the course of operation of said apparatus.

9. An apparatus in accordance with claim 8, also including timing means arranged to generate a predetermined number of timing pulses for each complete revolution of said drum, said predetermined time interval corresponding to the generation of a further predetermined number of said timing pulses.

* * * * *